US009493319B2

(12) United States Patent
Tsuchiya et al.

(10) Patent No.: US 9,493,319 B2
(45) Date of Patent: Nov. 15, 2016

(54) AUTOMATIC DOCUMENT FEEDER AND IMAGE FORMING APPARATUS

(71) Applicants: Fumiaki Tsuchiya, Kanagawa (JP); Kenichi Kuroda, Kanagawa (JP); Yasuhiro Tomita, Kanagawa (JP); Maki Nishide, Kanagawa (JP)

(72) Inventors: Fumiaki Tsuchiya, Kanagawa (JP); Kenichi Kuroda, Kanagawa (JP); Yasuhiro Tomita, Kanagawa (JP); Maki Nishide, Kanagawa (JP)

(73) Assignee: RICOH COMPANY, LIMITED, Tokyo (JP)

( * ) Notice: Subject to any disclaimer, the term of this patent is extended or adjusted under 35 U.S.C. 154(b) by 0 days.

(21) Appl. No.: 14/255,015

(22) Filed: Apr. 17, 2014

(65) Prior Publication Data

US 2014/0319754 A1 Oct. 30, 2014

(30) Foreign Application Priority Data

Apr. 26, 2013 (JP) ..... 2013-093440

(51) Int. Cl.
*G03G 15/00* (2006.01)
*B65H 5/26* (2006.01)
*B65H 7/20* (2006.01)

(52) U.S. Cl.
CPC *B65H 5/26* (2013.01); *B65H 7/20* (2013.01); *G03G 15/602* (2013.01); *B65H 2301/5111* (2013.01); *B65H 2511/512* (2013.01)

(58) Field of Classification Search
CPC ..... B65H 2301/5111; B65H 2511/512; H04N 1/00519; H04N 1/00538; H04N 1/32144; H04N 2201/3269; H04N 2201/3271; G03G 15/60
See application file for complete search history.

(56) References Cited

U.S. PATENT DOCUMENTS

| | | | | |
|---|---|---|---|---|
| 4,901,158 | A * | 2/1990 | Sato et al. | 358/296 |
| 5,089,858 | A | 2/1992 | Ohno et al. | |
| 5,093,690 | A | 3/1992 | Ohno et al. | |
| 5,535,022 | A * | 7/1996 | Itoigawa | 358/496 |
| 5,917,617 | A * | 6/1999 | Hatano et al. | 358/498 |
| 6,188,468 | B1 * | 2/2001 | Miyajima | 355/407 |
| 6,318,253 | B1 * | 11/2001 | Ohno | 101/33 |
| 6,571,074 | B2 * | 5/2003 | Suzuki et al. | 399/124 |
| 6,628,433 | B1 * | 9/2003 | Westcott et al. | 358/474 |
| 6,829,453 | B2 * | 12/2004 | Kouzu | 399/124 |
| 7,469,891 | B2 * | 12/2008 | Takahashi | 271/162 |

FOREIGN PATENT DOCUMENTS

| | | |
|---|---|---|
| JP | 07-079313 | 3/1995 |
| JP | 09-236949 | 9/1997 |
| JP | 2013-243660 A | 12/2013 |

* cited by examiner

*Primary Examiner* — Ernesto Suarez
(74) *Attorney, Agent, or Firm* — Harness, Dickey & Pierce, P.L.C.

(57) ABSTRACT

An automatic document feeder includes a sheet feeding tray on which a document is stacked; a slit glass on which the document is scanned while moving; a discharge path in which the document is conveyed after the document is scanned; a document discharge unit to which the document is discharged through the discharge path; and a stamp device that makes a mark on a scanned surface of the document being in the discharge path. The stamp device includes a printing unit that faces the scanned surface of the document. The printing unit is movable between a first position at which the printing unit faces the document being in the discharge path and a second position at which the printing unit is retracted from the discharge path.

19 Claims, 12 Drawing Sheets

AUTOMATIC DOCUMENT FEEDER AND IMAGE FORMING APPARATUS

PRIORITY STATEMENT

The present application claims priority to and incorporates by reference the entire contents of Japanese Patent Application No. 2013-093440 filed in Japan on Apr. 26, 2013.

BACKGROUND OF THE INVENTION

1. Field of the Invention

The present invention relates to an automatic document feeder and an image forming apparatus.

2. Description of the Related Art

It is well-known that an image forming apparatus, such as a copier, printer, or facsimile machine, has a configuration such that an automatic document feeder is mounted on a document placement board and, if there are multiple documents, the documents are separated one by one and are continuously delivered.

In the automatic document feeder, in some cases, a stamp, or the like, is printed on a delivered document for which image reading has been finished, whereby the document for which reading has been finished is distinguishable on the basis of the printed marking.

There is an automatic document feeder that includes a printing mechanism that has a configuration in which, a stamp device is provided in a chassis that is provided near a discharge roller included in the automatic document feeder, the stamp device faces the discharge roller, and part of the chassis is configured to open and close so that it can be removed to outside during replacement of a printing unit of the stamp device (For example, Japanese Patent No. 3345108).

A proposed configuration in which a stamp device is removable is such that, in an automatic document feeder that includes a slit glass for scanning while a document is conveyed, other than a contact glass for scanning while a document is placed, a frame including the stamp device is provided in the vicinity of the slit glass in an openable and closable manner, and the frame is opened when the stamp device is replaced so that the stamp device is exposed to outside (For example, Japanese Patent No. 3411438).

The stamp device that applies marking to a recording sheet is a unit that requires an operation to be performed from outside during replacement of a printing unit.

With the configuration disclosed in the above-described patent literatures, the stamp device is provided in a state where it faces a conveyance path of a recording sheet, and a conveyance path member that is used as the conveyance path or a frame that is provided associated with the conveyance path is opened during replacement of the printing unit so that the printing unit is exposed to outside; therefore, it is difficult to check the printing unit from outside.

Therefore, it is assumed that, during replacement of the printing unit, it is difficult to view a member of the conveyance path, in which the printing unit is provided, and the stamp device from outside and, if no instruction is given to open the conveyance path member or the frame during replacement, it is difficult to check the position of the printing unit; therefore, there is a possibility that a replacement operation takes a lot of trouble.

As the apparatus does not include a configuration that makes it possible to check the printing unit, it is necessary to perform an operation to determine the position of the printing unit by referring to, for example, the manual when an operator replaces the printing unit; thus, the replacement operation is troublesome.

Therefore, there is a need to provide an automatic document feeder that includes a simple configuration for determining the location of the stamp device and easily performing an operation to replace the printing unit.

SUMMARY OF THE INVENTION

It is an object of the present invention to at least partially solve the problems in the conventional technology.

According to an embodiment, there is provided an automatic document feeder that includes a sheet feeding tray on which a document is stacked; a slit glass on which the document is scanned while moving; a discharge path in which the document is conveyed after the document is scanned; a document discharge unit to which the document is discharged through the discharge path; and a stamp device that makes a mark on a scanned surface of the document being in the discharge path. The stamp device includes a printing unit that faces the scanned surface of the document. The printing unit is movable between a first position at which the printing unit faces the document being in the discharge path and a second position at which the printing unit is retracted from the discharge path.

According to another embodiment, there is provided an image forming apparatus that includes the automatic document feeder according to the above embodiment.

The above and other objects, features, advantages and technical and industrial significance of this invention will be better understood by reading the following detailed description of presently preferred embodiments of the invention, when considered in connection with the accompanying drawings.

DETAILED DESCRIPTION OF THE PREFERRED EMBODIMENTS

Exemplary embodiments of the present invention are explained in detail below with reference to the accompanying drawings.

Figure 1:
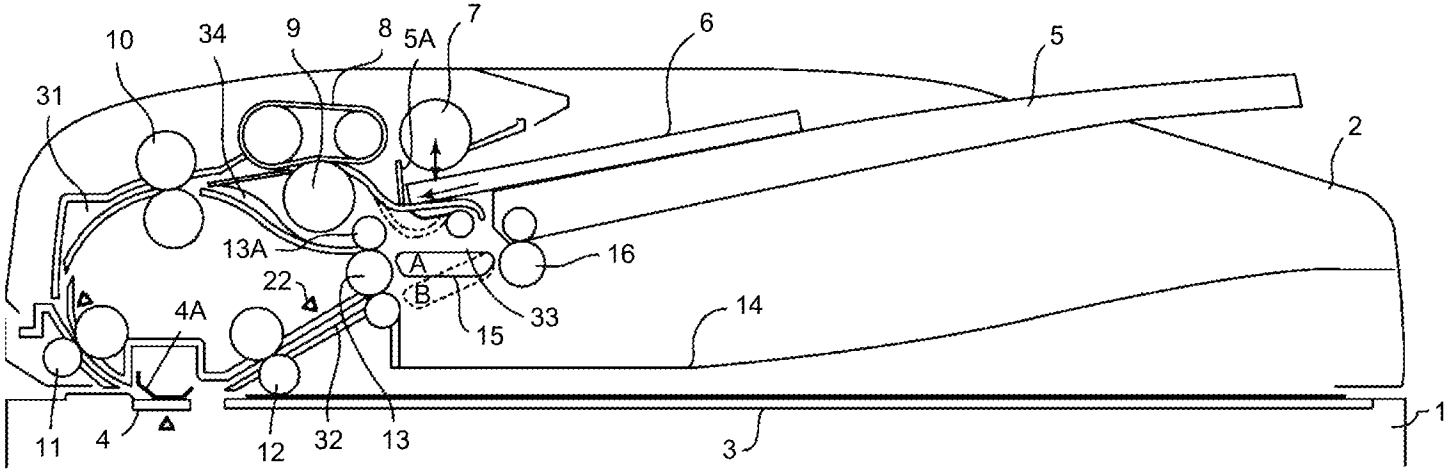
FIG. 1 is a diagram that illustrates a configuration of an automatic document feeder according to an embodiment of the present invention.

FIG. 1 illustrates a state where an automatic document feeder 2 is mounted on an image forming apparatus 1.

In FIG. 1, the reference numeral 1 denotes the image forming apparatus and, on the top of the image forming apparatus 1 are provided a contact glass 3 that is a document placement board and a slit glass 4 that has a smaller area than the contact glass 3.

The contact glass 3 is used for scanning a single document or a document of a book while it is placed thereon, and the slit glass 4 is used as a document conveying surface for scanning while a document is conveyed.

The automatic document feeder 2 is provided on the top of the main body of the image forming apparatus 1 in a state such that it is openable and closable from the front side thereof toward the back side by using, as a base end, a hinge mechanism unit that is provided on the back side of the drawing plane of FIG. 1.

A document can be placed on the contact glass 3 when the automatic document feeder (hereafter, sometimes represented by using the reference mark DF as an abbreviation for a document feeder for convenience) 2 is open by using the hinge mechanism as described above, and scanning for the document can be conducted by the slit glass 4 while it is closed.

A document of a book or a manually supplied single document are the subjects in the case of using the contact glass 3, and multiple documents that can be continuously conveyed to the slit glass 4 are the subjects in the case of using the slit glass 4.

In the automatic document feeder 2 is provided a document table 5 on which a to-be-scanned document 6 can be placed, and the feeding-side leading end of the document 6 that is placed on the document table 5 comes into contact with a stopper piece 5A that is provided on the side of the document table 5, whereby the leading end thereof is aligned.

A feeding roller 7 is provided on the document feeding side of the document table 5, the feeding roller 7 being rotatable while it is in contact with the uppermost document.

After the document 6 is fed from the document table 5 by the feeding roller 7, the document 6 is conveyed toward the position where a sheet feeding belt 8 and a separation roller 9 are in contact with each other, the sheet feeding belt 8 being located anterior to the feeding roller 7 in a feeding direction (the direction of the illustrated arrow), and the separation roller 9 being in contact with the sheet feeding belt 8 and being rotatable in accordance with it.

The sheet feeding belt 8 and the separation roller 9 are moved in the opposite directions and constitute a separation mechanism that, when multiple documents are fed and conveyed, separates the uppermost document from the other documents and conveys it.

A pair of feeding rollers 10 is provided at the position to which a single document, which is separated by the sheet feeding belt 8 and the separation roller 9, is moved, a first conveyance path 31 is located anterior to the pair of feeding rollers 10, and the first conveyance path 31 reverses the moving direction of a document that is fed from the document table 5.

The above-described pair of feeding rollers 10 is provided on the side of the first conveyance path 31 through which a document enters, and a pair of pre-reading rollers 11 is provided on the side thereof through which a document exits.

The slit glass 4 that constitutes a document read unit and a pressurizing plate 4A that is in contact with it to press a document are provided at the position to which the pair of pre-reading rollers 11 conveys a document.

When a scanned surface of a document, which is fed by the pair of pre-reading rollers 11, is pressed against the slit glass 4, it can be moved while it is made flat over the entire surface of what is called the slit glass 4.

A pair of post-reading rollers 12 and a pair of sheet discharge rollers 13 are provided, along the direction in which a document is moved, at the position into which a document is discharged from the slit glass 4 that is used as a read unit, and a second conveyance path 32 is formed between the positions where the pairs of rollers are provided.

In the present embodiment, a document can be conveyed through the second conveyance path 32 in the manner described below.

Specifically, there is a case where, after scanning, a document is continuously discharged into a sheet discharge tray 14 that is a document discharge unit that is used as a discharge path, and there is a case where a document is circulated to the side of the document table 5 and is then fed toward the slit glass 4 from the side of the document table 5 again due to a switchback operation.

In the former case, one surface of a document corresponds to a scanned surface and, in the latter case, both surfaces of a document correspond to a scanned surface.

In FIG. 1, the following configuration is used as the configuration for conveying a document toward the slit glass 4 again after the document is moved through the second conveyance path 32 and the scanned surface thereof is turned over due to a switchback operation on the side of the document table 5.

A switch claw 15 is provided to switch the moving direction in which a document is moved from the second conveyance path 32 toward the document table 5, i.e., to the side of the document table (the position indicated by the reference mark B in FIG. 1) and to the side of the sheet discharge tray 14 (the position indicated by the reference mark A in FIG. 1). The position where the switch claw 15 is provided is a third conveyance path 33.

A pair of reverse rollers 16 is provided on an extended line of the third conveyance path 33 in the moving direction of a document, i.e., in a switchback direction due to the switch claw 15, the pair of reverse rollers 16 being provided on the side of the document table 5. Furthermore, a reverse conveying roller 13A is provided at the position to which a document is conveyed after the moving direction thereof is reversed by the pair of reverse rollers 16.

A document is conveyed by each of the rollers, is passed through a fourth conveyance path 34 that meets the first conveyance path 31, and is moved with the reversed scanned surface facing the slit glass 4.

Furthermore, the automatic document feeder 2 includes a structure for detecting a case where a conveyance failure occurs in each of the conveyance paths. Specifically, a document detector 22 is provided in the second conveyance path 32, the document detector 22 including an optical sensor that is capable of determining the presence or absence of a document in accordance with the state of reflected light. If the document detector 22 does not detect a document even if a predetermined time elapses or if the document detector 22 continuously detects a document even if a predetermined time elapses, it can determine that a paper jam has occurred, stop the apparatus, and give an alarm to a user.

Figure 2:
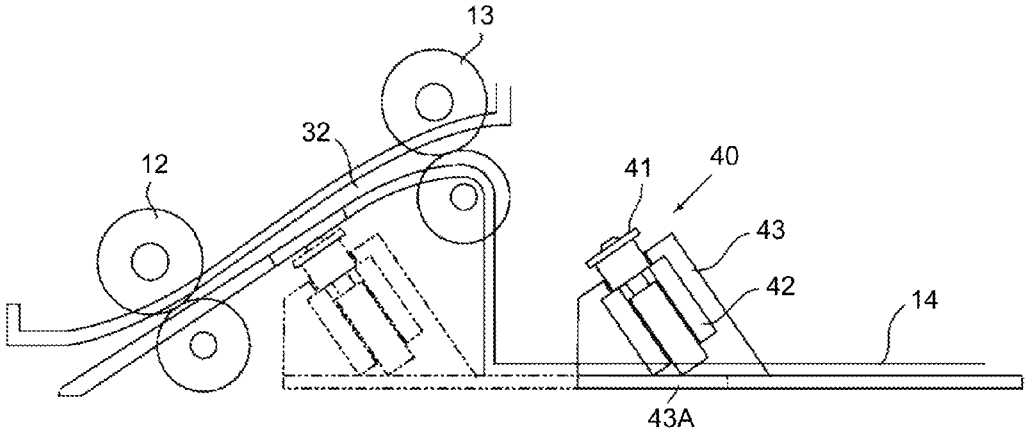
FIG. 2 is a diagram that illustrates a configuration of the relevant part of the automatic document feeder according to the embodiment of the present invention.

Furthermore, although a detailed explanation is given with reference to FIG. 2 and subsequent figures, a stamp device 40 is provided in the second conveyance path 32 to make a mark on the scanned surface of a document for which reading has been finished. The stamp device 40 is used for making a mark on a predetermined position of the scanned surface of a document for which reading has been finished in accordance with a user's instruction.

In the automatic document feeder 2 that has the above-described configuration, it is possible to select reading that is intended for one side of a document or reading that is intended for two sides of a document. An explanation is given below of the manner of conveying a document in accordance with a reading mode.

In the case of document two-sided reading (two-sided mode), after a document is delivered from the separation unit, it passes through the first conveyance path 31 in order to read a first image side thereof, and an image is read by the slit glass 4 that is used as the read unit. After reading, it passes through the second conveyance path 32 and is then conveyed to the third conveyance path for switchback reverse.

The reverse rollers 16 are rotated in a clockwise direction, and the switch claw 15 is held at the position B.

When the document is conveyed to the third conveyance path 33, the rear end thereof is passed through the pair of sheet discharge rollers 13, is delivered for a certain distance, and is then conveyed to the fourth conveyance path 34 in accordance with a reverse rotation (in a counterclockwise direction) of the reverse rollers 16. At that time, the switch claw 15 is moved to the position A.

The document is passed through the fourth conveyance path 34 in accordance with the rotation of the sheet discharge roller 13 and is passed through the first conveyance path 31 by the feeding rollers 10 so that a second image side thereof is read by the slit glass 4 that is used as the read unit.

If it is to be continuously discharged after the second image side is read, it is conveyed to the sheet discharge tray 14 via the second conveyance path 32.

If it is to be turned over again in order to adjust the page sequence, it is passed through the third conveyance path 33 by the switch claw 15 and, after switchback reverse, it is conveyed to the fourth conveyance path 34.

If it is turned over again, it is conveyed to the sheet discharge tray 14 via the first conveyance path 31 and the second conveyance path 32.

The characteristics of the present embodiment of the automatic document feeder 2 that has the above-described configuration are explained in the following.

The characteristic of the present embodiment is that it is possible to check the location of the stamp device 40 without the need to perform an operation to open the automatic document feeder 2 or open part of the image forming apparatus 1. Specifically, the characteristic is that the stamp device 40 provided in the second conveyance path 32 has a configuration that makes it possible to easily check the location of a printing unit 41 from outside in order to perform an operation to replace the printing unit 41.

FIG. 2 is a diagram that illustrates, in an enlarged manner, the sheet discharge tray 14 and the second conveyance path 32 that corresponds to the path for discharging a document toward the sheet discharge tray 14.

In FIG. 2, the stamp device 40 includes, as relevant units, the printing unit 41 that is opposed to the scanned surface of a document that is located in the second conveyance path 32, a drive solenoid 42 that is a drive unit that moves the printing unit 41 close to or away from the scanned surface of a document, and a holding member 43.

Although not illustrated in detail, the holding member 43 includes a slidable member 43A that is provided on the lower surface of the sheet discharge tray 14 and is movable, i.e., slidable, on the sheet discharge tray 14 along the direction in which a document is moved.

Specifically, by an undepicted slide drive unit or a manual operation, it can be moved to the position indicated by the two-dot chain line in FIG. 2, i.e., the position opposed to a document that moves through the second conveyance path 32, and to the position indicated by the solid line in FIG. 2, i.e., the position retracted from the second conveyance path 32.

In the present embodiment, the position retracted from the second conveyance path 32 corresponds to the state where the holding member 43 is positioned within the sheet discharge tray 14 so that it is possible to check the location of the printing unit 41 from outside.

Furthermore, the holding member 43 is configured to slide within a slit (not illustrated) that is formed in part of the sheet discharge tray 14 and within a space between rollers in a case where the sheet discharge roller 13 is provided such that it is divided in the axial direction. Moreover, although the setting of the holding member 43 at each position is not illustrated, for example, a configuration is such that an engagement section, or the like, is provided on a slide path and it comes into contact with the engagement section so that it is set at each position.

With the above-described configuration of the present embodiment, when the printing unit 41 is replaced, the slidable member 43A included in the holding member 43 is retracted along the direction in which the sheet discharge tray 14 extends, i.e., the direction in which a document is moved, to the position where the printing unit 41 does not face a document in the second conveyance path 32.

Therefore, when the printing unit 41 faces a document in the second conveyance path 32, the location of the printing unit 41 is not certain; however, if the holding member 43 is simply slid from the side of the second conveyance path 32 to outside, the location of the stamp device 40 can be checked. Thus, it is possible to eliminate the need for an operation to open the automatic document feeder 2 or open part of the image forming apparatus 1. Furthermore, when it is determined that the holding member 43 is located within the sheet discharge tray 14, the printing unit 41 is in a position for replacement; therefore, a replacement operation can be quickly performed.

Figure 3:
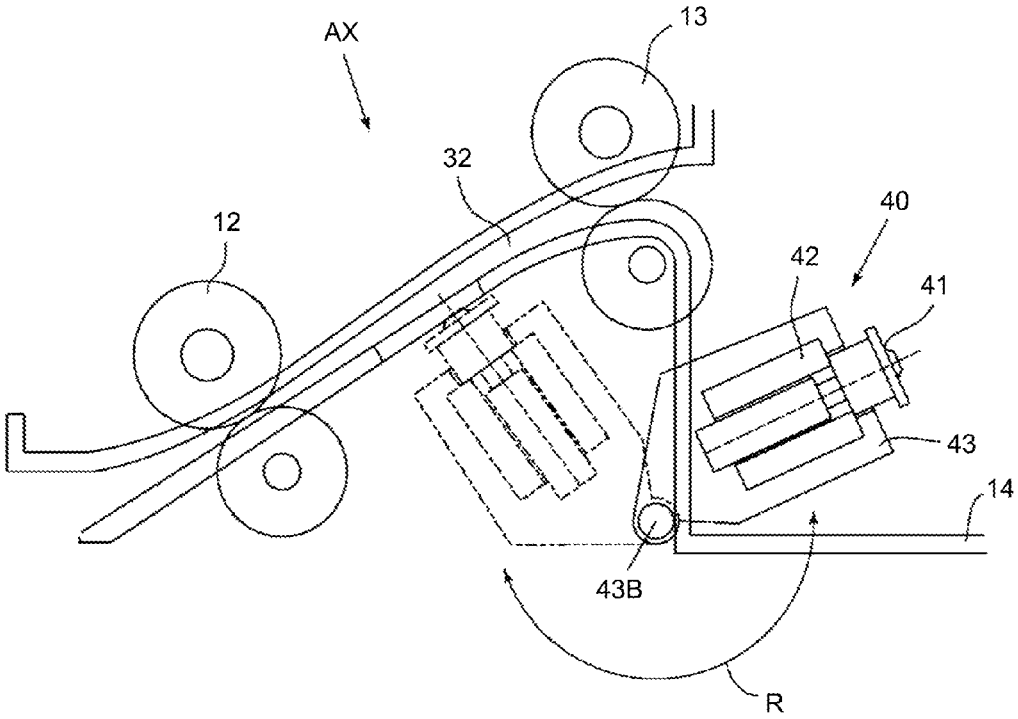
FIG. 3 is a diagram that illustrates a partial modification of the configuration of the relevant part illustrated in FIG. 2.

FIG. 3 is a diagram that illustrates a modification of the configuration for moving the holding member 43 to the position at the holding member 43 faces a document in the second conveyance path 32 and to the position at which the holding member 43 is retracted from the second conveyance path 32.

In FIG. 3, contrary to the case illustrated in FIG. 2, the holding member 43 is configured to rotate instead of sliding.

Specifically, a support rod 43B is provided in the vicinity of the sheet discharge tray 14, the support rod 43B being inserted through a bottom section of the holding member 43. The holding member 43 can be rotated around the support rod 43B that is a supporting point to the position where the printing unit 41 faces a document in the second conveyance path 32 and which is indicated by the two-dot chain line in FIG. 3 and to the position where it is retracted from the second conveyance path 32.

Furthermore, in this case, the rotational trajectory may be the trajectory that passes through the gap between the rollers in a case where the sheet discharge roller 13 is divided in the axial direction; however, in consideration of the following reason, it is preferable that it be rotated on the side of the bottom of the sheet discharge tray 14 as indicated by the reference mark R in FIG. 3. Specifically, the reason is that, if it passes through the gap between the positions where the sheet discharge rollers 13 are installed, it can interfere with the rotation shaft.

Furthermore, for positioning in the above case, an undepicted engagement section may be used in the same manner as the case illustrated in FIG. 2.

Figure 4:
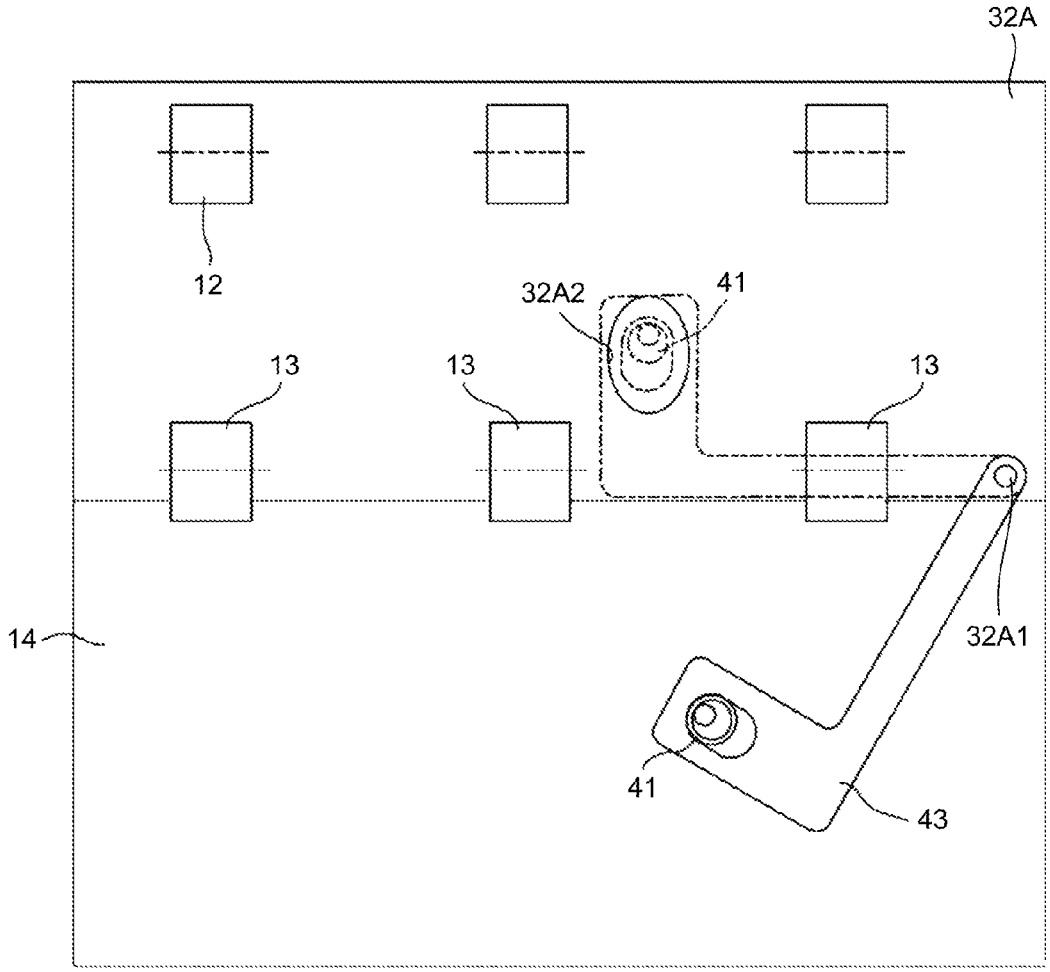
FIG. 4 is a plan view that illustrates a modification of the configuration of the relevant part illustrated in FIG. 3.

FIG. 4 is a diagram that illustrates a modification of the configuration for rotating the holding member 43 when viewed from above as indicated by arrow AX in FIG. 3.

In FIG. 4, the holding member 43 is configured to have the rotational trajectory in a horizontal direction instead of the rotational trajectory in a vertical direction as illustrated in FIG. 3.

Specifically, the base end of the holding member 43 is secured to a support rod 32A1 that is provided on part of a conveyance path member 32A that constitutes the second conveyance path 32, and the printing unit 41 is provided on the rotary end thereof.

Furthermore, an opening section 32A2 is formed on part of the conveyance path member 32A that is used as the second conveyance path 32, the printing unit 41 being exposed through the opening section 32A2.

The opening section 32A2 is an elongate hole that is formed at the position where the printing unit 41 can face a document in the second conveyance path 32. It is an elongate hole in order to absorb the misalignment of the printing unit 41 when it is exposed.

With this configuration, if the printing unit 41 is replaced in the same manner as that in the configuration illustrated in FIG. 3, the holding member 43 is rotated to the position where the printing unit 41 is retracted from the second conveyance path 32.

If the printing unit 41 faces a document in the second conveyance path 32, the location of the printing unit 41 is not certain; however, if the holding member 43 is simply slid from the side of the second conveyance path 32 to outside, the location of the stamp device 40 can be determined.

Therefore, it is possible to eliminate the need for an operation to open the automatic document feeder 2 or open part of the image forming apparatus 1. Furthermore, when it is determined that the holding member 43 is located within the sheet discharge tray 14, the printing unit 41 is in a position for replacement; therefore, it is possible to quickly perform a replacement operation.

During replacement of the printing unit 41, for example, the document table 5 is sometimes opened upward in order to check the stamp device 40 that is moving underneath.

Therefore, after the printing unit 41 is replaced, the stamp device 40 is returned to the position of use, i.e., the position facing the second conveyance path 32; however, there is a possibility that the stamp device 40 fails to return to the above-described position of use. If it is not determined whether it fails to return, it is difficult to perform a printing operation accurately.

Therefore, as described below, the present embodiment includes a configuration for determining whether the stamp device 40 is returned from the position of replacement to the position of use and includes a configuration for returning it to the position of use almost automatically. It is noted here that the same members as those illustrated in FIGS. 2 to 4 are denoted by the same reference numerals in FIG. 5 and subsequent figures and explanations thereof are omitted.

Figure 5:
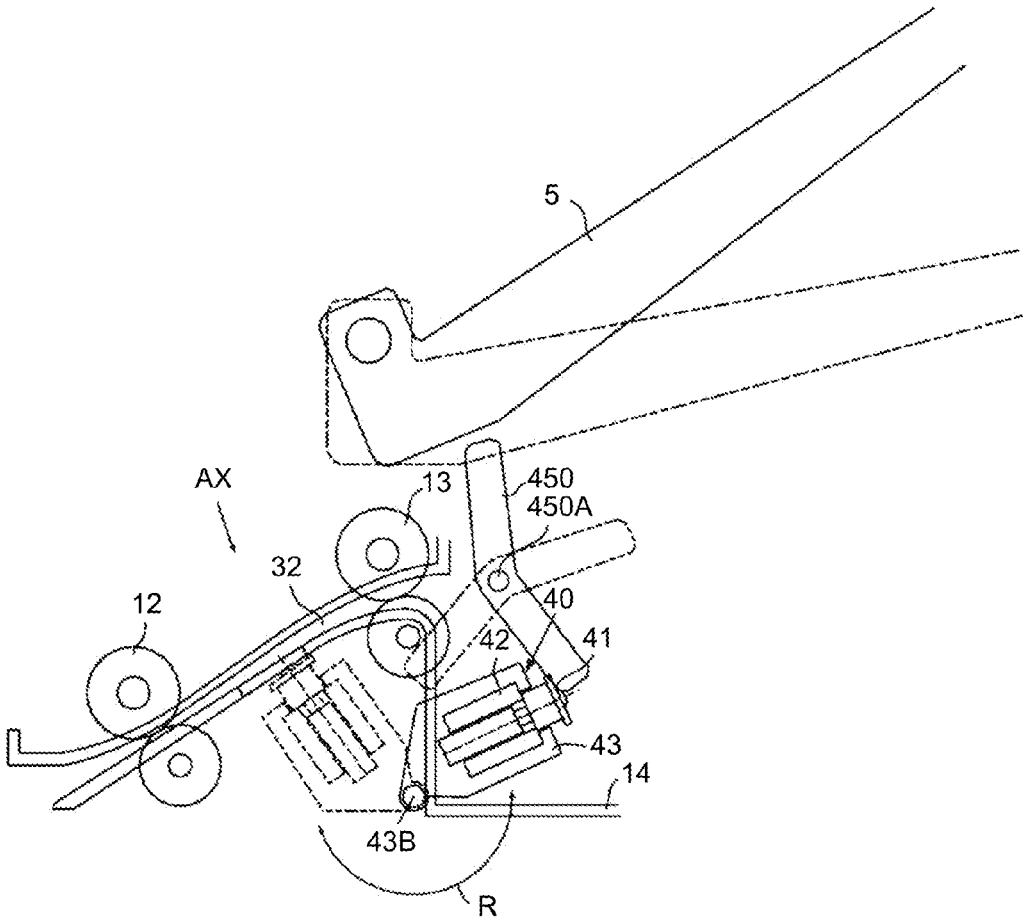
FIG. 5 is a diagram that illustrates an example of, in the configuration of the relevant part illustrated in FIG. 3, a configuration for checking whether a stamp device is returned.
Figure 6:
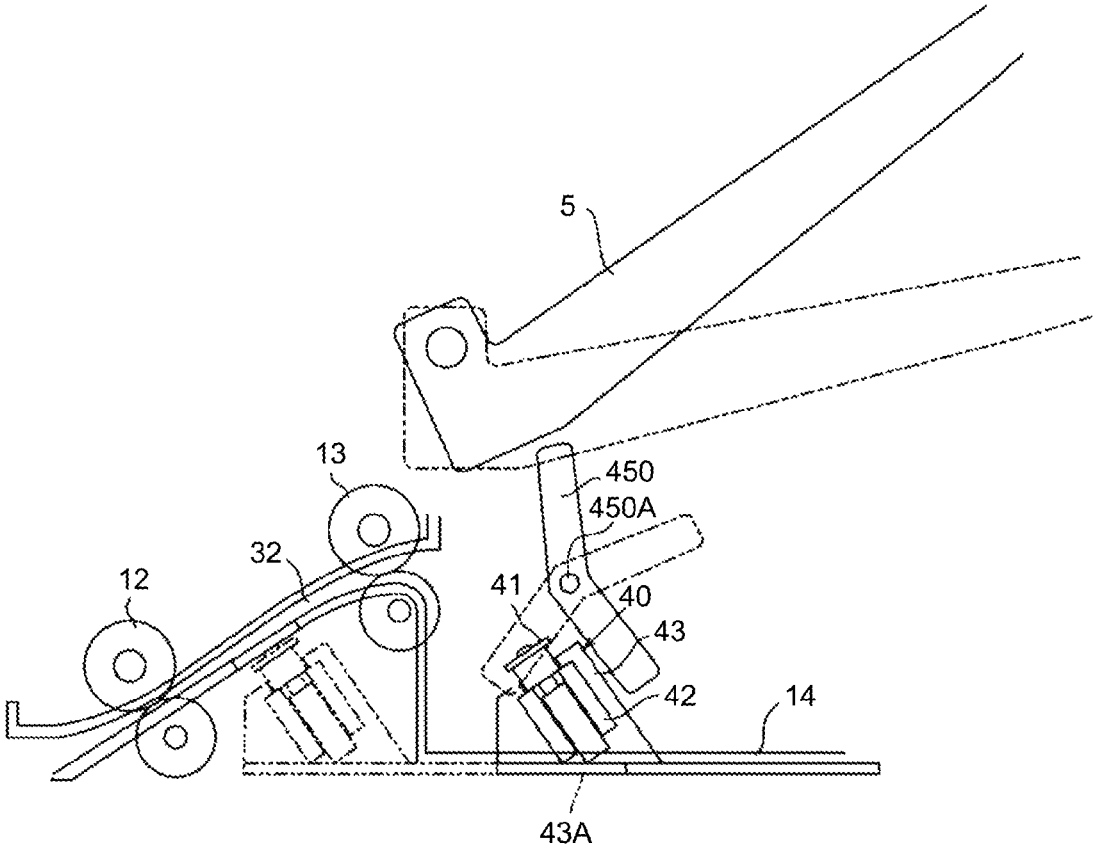
FIG. 6 is a diagram that illustrates another example of, in the configuration of the relevant part illustrated in FIG. 2, the configuration for checking whether a stamp device is returned.
Figure 7:
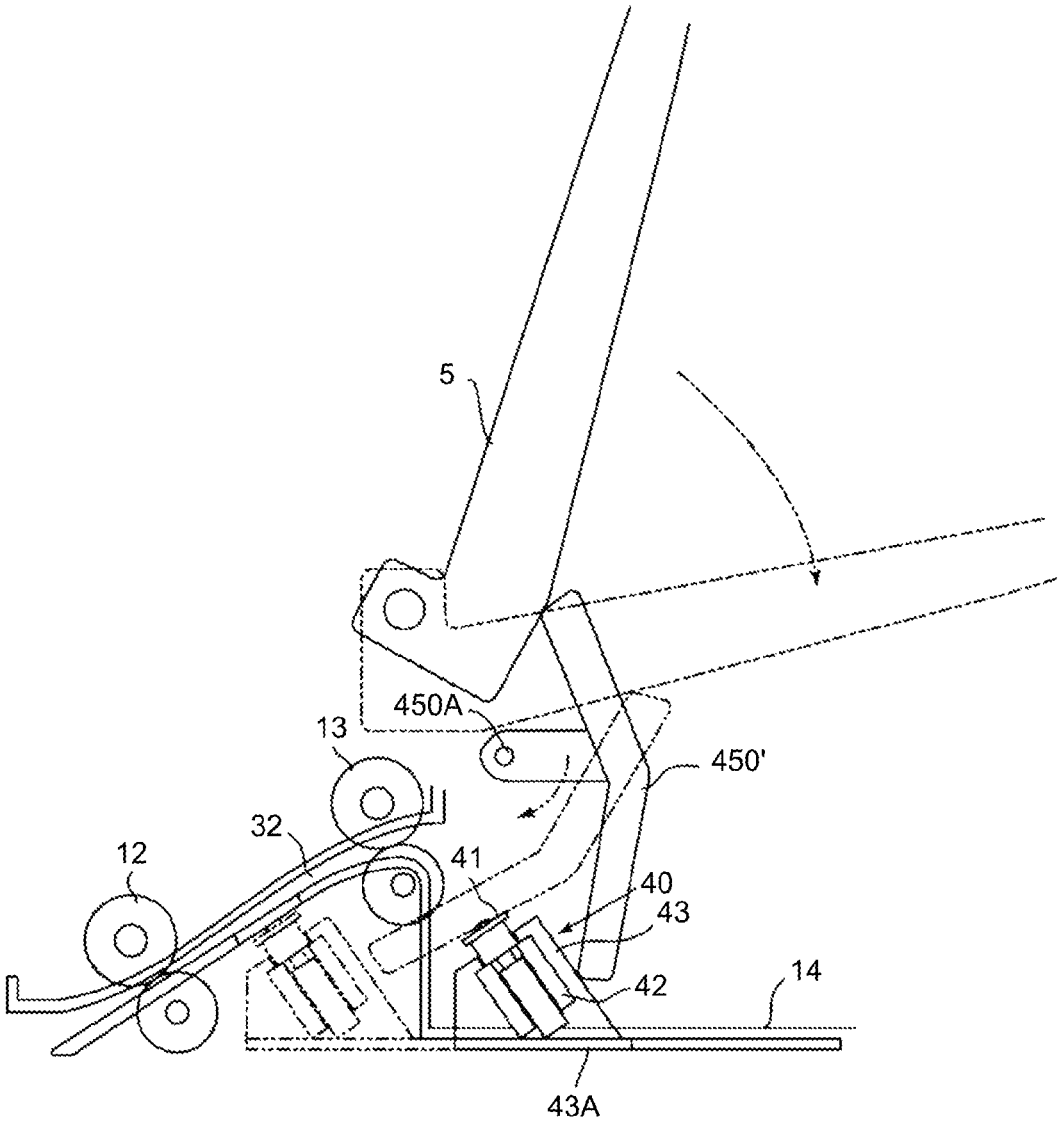
FIG. 7 is a diagram that illustrates a modification of the relevant part in the configuration illustrated in FIG. 6.

FIGS. 5 to 7 illustrate the configuration for determining whether the stamp device 40 is returned to the position of use in accordance with the state of the document table 5, which is used as a sheet feeding tray, during a return operation.

FIG. 5 illustrates a case where it is intended for the configuration illustrated in FIG. 3 and, in FIG. 5, a sheet-feeding tray position regulating member 450 is provided above the holding member 43 of the stamp device 40 that moves under the document table 5 and on the sheet discharge tray 14, the sheet-feeding tray position regulating member 450 being intended for the document table 5.

The sheet-feeding tray position regulating member 450 is a member that is rotatable in accordance with a movement of the holding member 43 between the position facing a document in the second conveyance path 32 and the position retracted from the second conveyance path 32.

Therefore, the sheet-feeding tray position regulating member 450 is rotatably supported by a support shaft 450A that is supported by an immovable section within the automatic document feeder, and a rotational behavior in a clockwise direction in the drawing is usually applied to it by an undepicted bias member.

A rotational trajectory is specified such that one rotary end of the sheet-feeding tray position regulating member 450 can face the holding member 43 of the stamp device 40 and the other rotary end thereof can face the bottom surface of the document table 5.

With the above-described configuration, in order to replace the printing unit 41 of the stamp device 40, the holding member 43 can rotate from the position where it faces the second conveyance path 32, i.e., where it can face a document that moves through the discharge path of the document, to the position where it is retracted from the second conveyance path 32, i.e., the position where it is retracted from the discharge path.

In accordance with the action of the holding member 43 of the stamp device 40 that rotates and moves to the position retracted from the second conveyance path 32, one rotary end of the sheet-feeding tray position regulating member 450 is pushed and moved so that the sheet-feeding tray position regulating member 450 is moved to rotate in a counterclockwise direction in the drawing.

The document table 5 is opened upward in advance in order to replace the printing unit 41.

After replacement of the printing unit 41 is finished, the return state where the stamp device 40 is moved to the position of use is determined in accordance with the return state of the document table 5.

Specifically, when the stamp device 40 is moved to the position of use, i.e., the position facing the second conveyance path 32, the sheet-feeding tray position regulating member 450 is accordingly rotated in a clockwise direction in the drawing due to its own bias. Thus, it can be separated from the bottom surface of the document table 5, and the document table 5 can be returned to the original position.

Conversely, if the stamp device 40 is not returned to the position of use, the sheet-feeding tray position regulating member 450 is not moved in conjunction with the stamp device 40. Therefore, one rotary end of the sheet-feeding tray position regulating member 450 continuously faces the bottom surface of the document table 5, and the document table 5 is not returned to the original position. Thus, it is possible to determine the return state of the stamp device 40 to the position of use on the basis of the return state of the document table 5 to the original position.

FIG. 6 illustrates a case where the sheet-feeding tray position regulating member 450 illustrated in FIG. 5 is provided and is intended for the configuration illustrated in FIG. 2.

In the case of the configuration illustrated in FIG. 6, the sheet-feeding tray position regulating member 450 is rotated in accordance with a movement of the stamp device 40 from the position facing the second conveyance path 32 to the position retracted from the second conveyance path 32, which is a discharge path.

As the operation performed after replacement of the printing unit 41 is the same as that illustrated in FIG. 5, an explanation thereof is omitted.

A configuration illustrated in FIG. 7 is characterized in that the stamp device 40 is returned to the position of use, i.e., the position facing the second conveyance path 32, in accordance with an operation to return the document table 5, which is opened upward during replacement of the printing unit 41, to the original position.

Specifically, contrary to the cases illustrated in FIGS. 5 and 6, the radius of rotation of a sheet-feeding tray position regulating member (denoted by the reference numeral 450' for convenience) is set to be larger so as to set a larger rotational moment.

In accordance with a movement of the stamp device 40 from the position opposed to the second conveyance path 32 to the position retracted from the second conveyance path 32, i.e., above the sheet discharge tray 14, the sheet-feeding tray position regulating member 450' is rotated in a direction to lift the document table 5.

When the document table 5 is returned to the original position after replacement of the printing unit 41, the sheet-feeding tray position regulating member 450' operates simultaneously with the return operation so as to move the stamp device 40 to the position of use.

Thus, even if the stamp device 40 fails to return to the position of use, the stamp device 40 can be returned to the position of use by returning the document table 5 to the original position.

Figure 8:
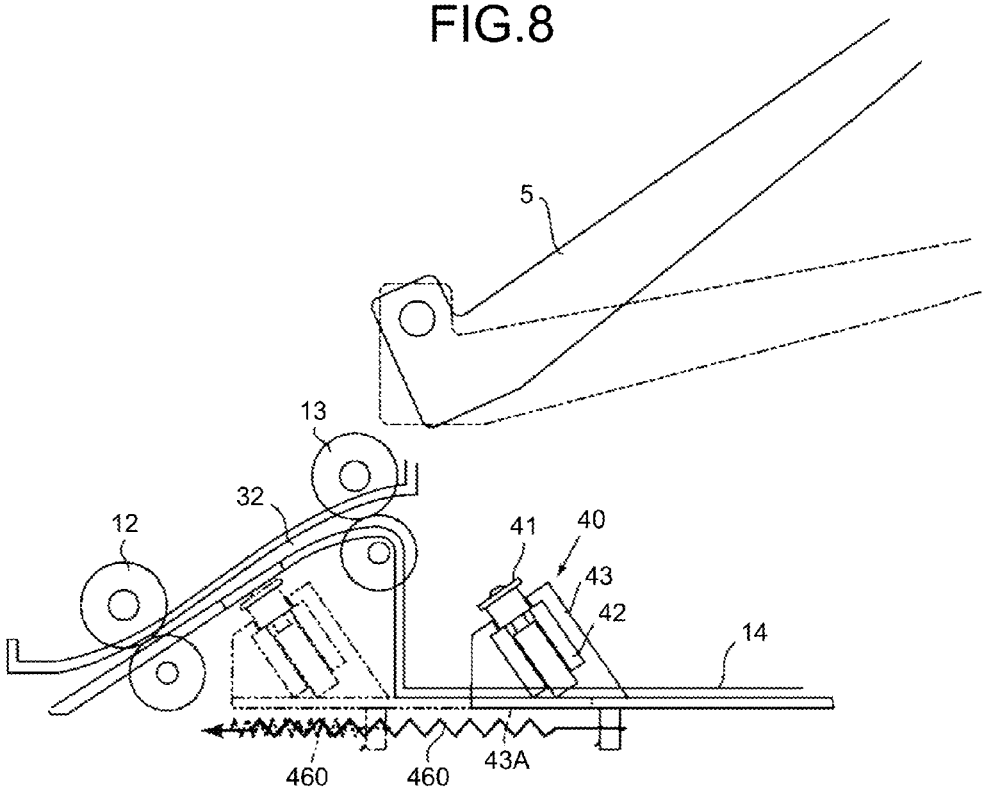
FIG. 8 is a diagram that illustrates a configuration for an operation to return the stamp device, which is intended for the configuration of the relevant part illustrated in FIG. 2.
Figure 9:
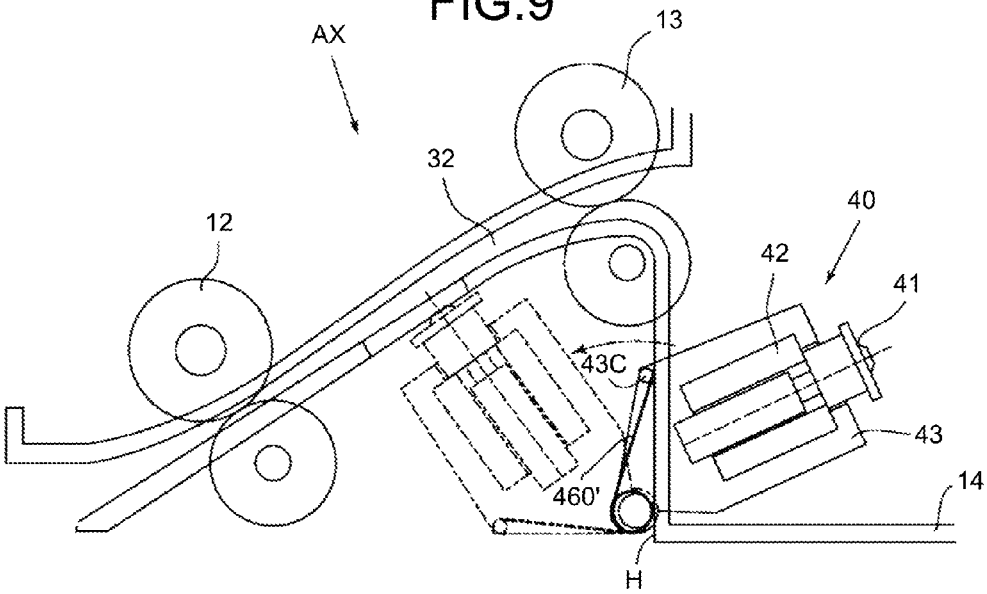
FIG. 9 is a diagram that illustrates a modification of the configuration of the relevant part illustrated in FIG. 8.
Figure 10:
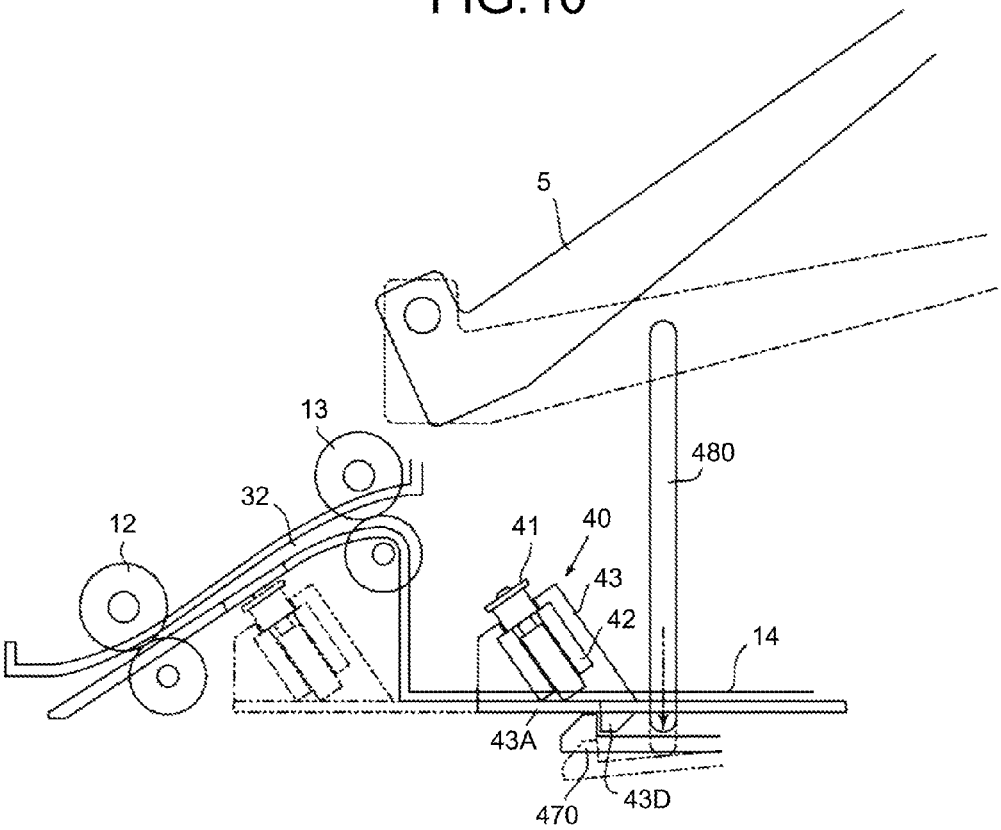
FIG. 10 is a diagram that illustrates another modification of the configuration illustrated in FIG. 8.

Furthermore, FIGS. 8 to 10 illustrate a configuration for returning the stamp device 40 to the position of use, i.e., the position facing the second conveyance path 32, almost automatically.

The configuration illustrated in FIG. 8 is a configuration in which the stamp device 40 including the printing unit 41 is forcibly biased by an elastic member 460 toward the position of use, i.e., the position facing the second conveyance path 32.

Specifically, the stamp device 40 is connected to the elastic member 460 that is provided between the stamp device 40 and the main body side (not illustrated) of the automatic document feeder.

As the stamp device 40 is moved from the position of use, i.e., the position facing the second conveyance path 32, to the retracted position, the elastic force of the elastic member 460 is increased. Thus, after replacement of the printing unit 41 is finished, the stamp device 40 can be returned to the position of use almost automatically due to the bias force of the elastic member 460 for which the elastic force has been increased after replacement.

Furthermore, in FIG. 8, the contracted elastic member 460 is illustrated by using a two-dot chain line, and the expanded elastic member 460 is illustrated by using a solid line.

With the above configuration, the stamp device 40 is returned to the position of use by the elastic member 460 almost automatically after replacement; therefore, the stamp device does not fail to return to the position of use after replacement. Furthermore, a coil spring for expansion or contraction, torsion spring, plate spring, rubber, or the like, is used as the elastic member 460.

FIG. 9 is a diagram that illustrates a modification of the relevant part of the configuration illustrated in FIG. 8 and, in the configuration illustrated in FIG. 9, a coiled spring (hereafter, also referred to as a coiled spring 460') is used as the elastic member 460'.

Coil end sections of the coiled spring 460' are engaged with an engagement pin 43C that is provided on part of the holding member 43 included in the stamp device 40 and with a wall surface (indicated by the reference mark H) of a chassis that constitutes the sheet discharge tray 14.

The elastic force of the elastic member 460', for which the coiled spring is used, is increased as the diameter of the elastic member 460' is reduced in accordance with a movement of the stamp device 40 from the position facing the second conveyance path 32 to the retracted position, i.e., above the sheet discharge tray 14. Therefore, when the stamp device 40 is moved from above the sheet discharge tray 14 to the position of use, i.e., the position facing the second conveyance path 32, the increased elastic force of the coiled spring 460' can be used.

With the above configuration, it is possible to prevent the stamp device 40 from failing to return to the position of use.

Furthermore, contrary to the case where a user holds the stamp device 40 at the position for replacement of the printing unit 41, it is possible to provide a mechanism for holding the stamp device 40 at the replacement position and for releasing the hold of the stamp device 40, as illustrated in FIG. 10, which is intended for the configuration illustrated in FIG. 8. An explanation is given below of this configuration.

In FIG. 10, although not illustrated, the holding member 43 of the stamp device 40 is coupled to an elastic member (the member denoted by the reference numeral 460 in FIG. 8) that is the same as that in the case illustrated in FIG. 8, and an engagement section 43D that has a trapezoidal shape in cross-section is provided in the holding member 43.

A printing-unit position regulating member 470 is provided in an immovable section (not illustrated) on the side of the automatic document feeder, the printing-unit position regulating member 470 having a snap-fit structure that includes an engagement piece that moves back and forth relative to the engagement section 43D so as to engage with it or release the engagement of it.

For example, a cantilever flexible member is used as the printing-unit position regulating member 470, and a hooked section is provided on the leading edge of the free end thereof so as to engage with the engagement section 43D.

A printing-unit position regulation removing member 480 is provided on the swing end of the printing-unit position regulating member 470 that is located closer to the base end thereof compared to the leading edge, the printing-unit position regulation removing member 480 being capable of removing the engagement between the engagement section 43D and the printing-unit position regulating member 470 in accordance with the operation to open and close the document table 5. Not only the member that has the above-described snap-fit structure but also a magnetic material, hook and loop fastener, friction member, or the like, is used as the printing-unit position regulating member 470 that includes an area that can be engaged with the engagement section 43D.

The printing-unit position regulation removing member 480 uses a link mechanism that operates in accordance with the operation to open and close the document table 5 and, when it is pushed downward in accordance with a downward movement of the document table 5 to the original position, it presses the printing-unit position regulating member 470 so as to remove the engagement with the engagement section 43D.

With the above configuration, if the stamp device 40 is moved from the position facing the second conveyance path 32 toward the sheet discharge tray 14 while the document table 5 is opened, the printing-unit position regulating member 470 is engaged with the engagement section 43D provided in the holding member 43. Thus, the stamp device 40 is held at the retracted position.

Furthermore, if the document table 5 is closed to the original position after replacement of the printing unit 41 is finished, the printing-unit position regulation removing member 480 accordingly moves so that the printing-unit position regulating member 470 is separated from the engagement section 43D, whereby the engagement is removed.

Thus, the stamp device 40 can be moved to the position of use, i.e., the position facing the second conveyance path 32, due to the bias of the elastic member (the member denoted by the reference numeral 460 in FIG. 8).

With the above configuration, it is possible to hold the stamp device 40 at the retracted position and forcibly return it to the position of use in accordance with the operation to open and close the document table 5; thus, it is possible to reduce the workload for holding it, and it is possible to prevent it from failing to return to the position of use.

Next, an explanation is given of a configuration for accurately returning the stamp device 40 to the position of use and setting the position thereof.

Figure 11:
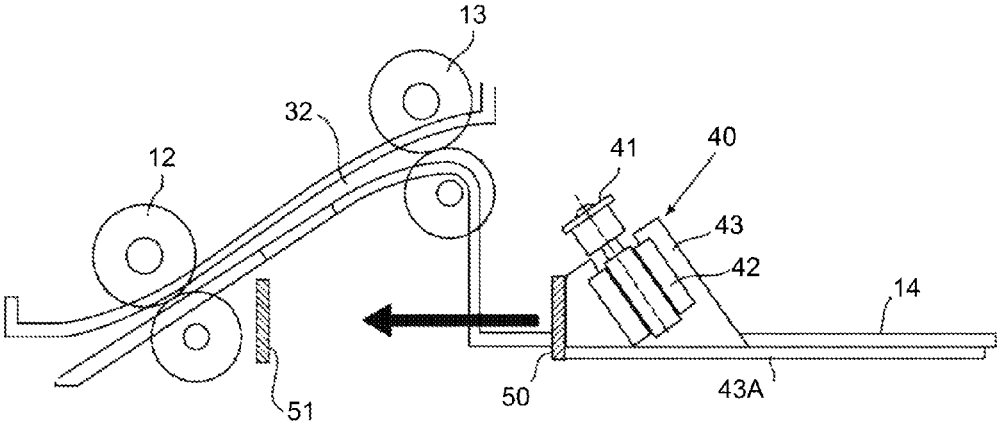
FIG. 11 is a diagram that illustrates an example of a configuration for accurately returning the stamp device 40 to the position of use and setting the position thereof, which is intended for the configuration of the relevant part illustrated in FIG. 2.

In FIG. 11, a magnetic member 51 is provided in an immovable section (not illustrated) of the automatic document feeder, and a magnetic member 50 is provided in the holding member 43 of the stamp device 40 and is located at the position opposed to the magnetic member 51.

The magnetic member 51 is provided in the immovable section at a position such that the position of the stamp device 40 can be set in the position of use, and the magnetic member 50, which is opposed thereto, is integrated with the holding member 43. FIG. 11 illustrates a state where the magnetic member 51 is provided in the vicinity of the position where it faces a document that moves through the second conveyance path 32.

Figure 12:
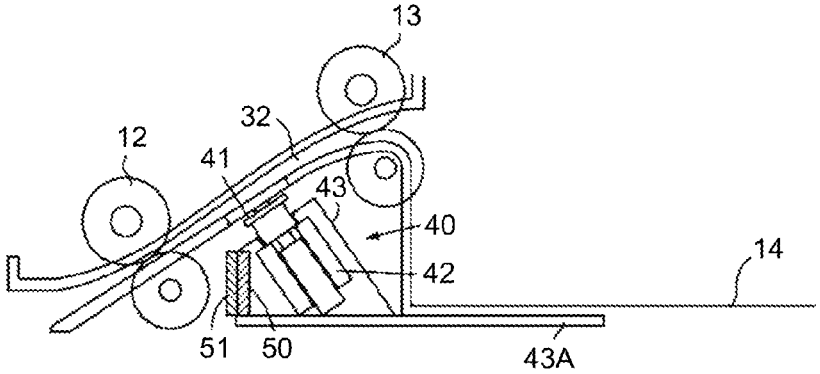
FIG. 12 is a diagram that illustrates one aspect of the configuration illustrated in FIG. 11.

Therefore, if the stamp device 40 is moved toward the position of use, i.e., the position facing the second conveyance path 32, after replacement of the printing unit 41, the stamp device 40 is moved to the position where the magnetic member 50 magnetically attracted to the magnetic member 51, as illustrated in FIG. 12.

As described above, the position where the two magnetic members 50 and 51 are attracted to each other corresponds to the position of use of the stamp device 40, i.e., the position where the printing unit 41 faces the second conveyance path 32.

When the printing unit 41 is moved to the position of use of the stamp device 40 that faces the second conveyance path 32, the position of the stamp device 40 can be set by using a magnetic force; therefore, it is possible to reduce the force required for movement, and it is not necessary to perform an operation to determine whether a movement to the position of use is ensured, to adjust the distance of movement, or the like.

Figure 13:
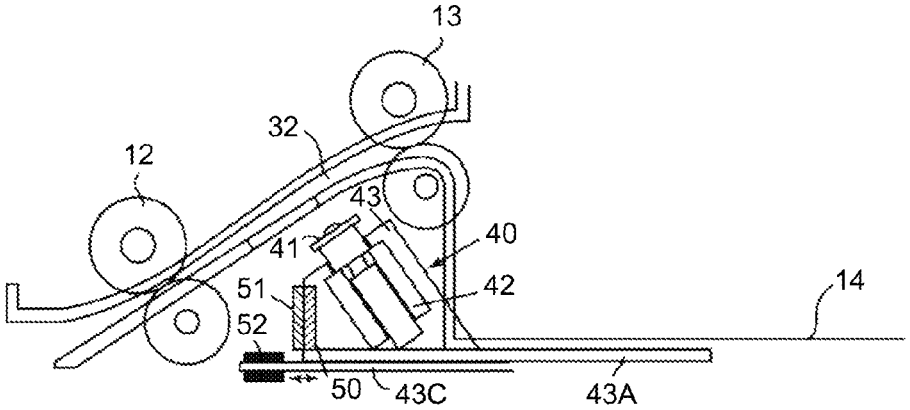
FIG. 13 is a diagram that illustrates a modification of the relevant part in the configuration illustrated in FIG. 11.

The configuration illustrated in FIG. 13 is a configuration that is intended for the configuration illustrated in FIG. 12 and that applies an auxiliary force during movement of the stamp device 40 to the position of use.

Specifically, a solenoid 52 is provided in the immovable section of the automatic document feeder in which the above-described magnetic member 51 is provided.

A linear solenoid in which a plunger is inserted through the inside thereof and is slidably mounted is used as the solenoid 52, and the plunger is secured to the bottom surface of the holding member 43 of the stamp device 40.

With the above configuration, the solenoid 52 is driven when the stamp device 40 is moved to the position of use, i.e., the position facing the second conveyance path 32, the stamp device 40 having been retracted from the second conveyance path 32 and being located above the sheet discharge tray 14.

When the solenoid 52 magnetically attracts the plunger so as to slide it, the holding member 43, which is integrated with the plunger, moves from above the sheet discharge tray 14 to the position facing the second conveyance path 32.

When the stamp device 40 moves to the position facing the second conveyance path 32, the magnetic member 50 is magnetically attracted to the magnetic member 51, whereby the movement to the position of use is facilitated and the positioning is conducted.

With the above-described configuration, the movement to the position of use can be facilitated due to not only the magnetic attraction between the magnetic members 50 and 51 but also the solenoid 52; therefore, it is possible to achieve an accurate movement for return to the position of use and the positioning.

The above-described configuration is a configuration for moving the stamp device 40 to the position retracted from the second conveyance path 32 during replacement of the printing unit 41 and a configuration for returning it to the position of use of the printing unit 41, i.e., the position facing the second conveyance path 32.

Next, an explanation is given of a configuration for performing an operation to replace the printing unit 41.

When the printing unit 41 is moved to the position retracted from the second conveyance path 32, the printing unit 41 is moved to a position on the sheet discharge tray 14 where it is easy to check it from outside, and the old printing unit 41 is removed from the holding member 43 and is replaced with the new printing unit 41.

To remove the printing unit, it is possible to use user's or serviceman's hands or fingers; however, as it is a relatively small area, it is sometimes difficult to perform an operation.

Therefore, the present embodiment uses a configuration that can protrude the printing unit 41 at a position where it is easily and automatically removed, in other words, at a position where it is easily held.

First, before the above configuration is explained, an explanation is given of an automatic document feeder that is the subject.

Figure 14:
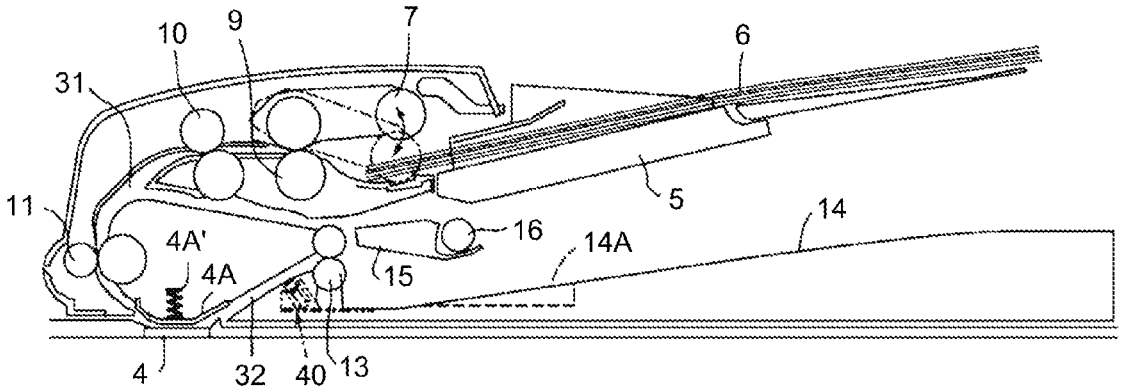
FIG. 14 is a diagram that illustrates another example of the automatic document feeder according to an embodiment of the present invention.

FIG. 14 is a diagram that illustrates an automatic document feeder that is used in the present embodiment and is different from the configuration illustrated in FIG. 1 in the following aspect.

That is, a slide section 14A is provided on part of the sheet discharge tray 14 on which a document is stacked, the slide section 14A is a tilted section that is used when a thin sheet is delivered, and an elastic member 4A' applies a contact behavior to the pressurizing plate 4A on the slit glass 4.

Figure 15:
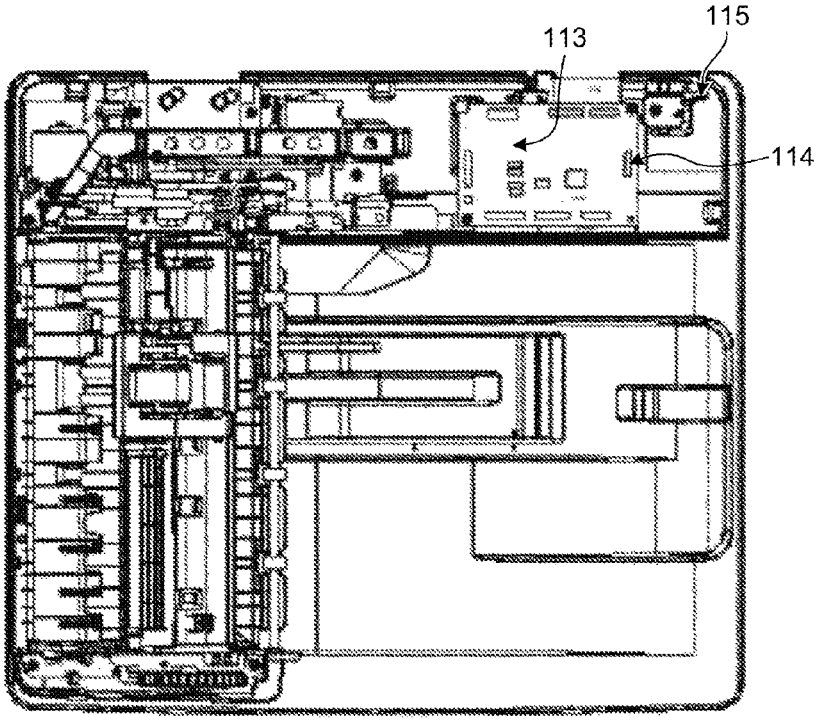
FIG. 15 is a diagram of the relevant part of the automatic document feeder illustrated in FIG. 14, when viewed from the top.

The operational state of a drive unit that is used in the automatic document feeder is controlled by an undepicted controller, and a communication cable that is connected to a socket 114 of a control board 113 is used for each drive unit and the controller, as illustrated in FIG. 15. The communication cable is interposed in a cable groove and is secured by a bracket 115 that is fixed to the board. Although not illustrated, marking for setting a fixed position is applied to the cable groove.

In the following, an explanation is given, with reference to FIGS. 16 to 18, of a configuration for performing an operation to replace the printing unit 41, which is intended for the above-described configuration.

Figure 16:
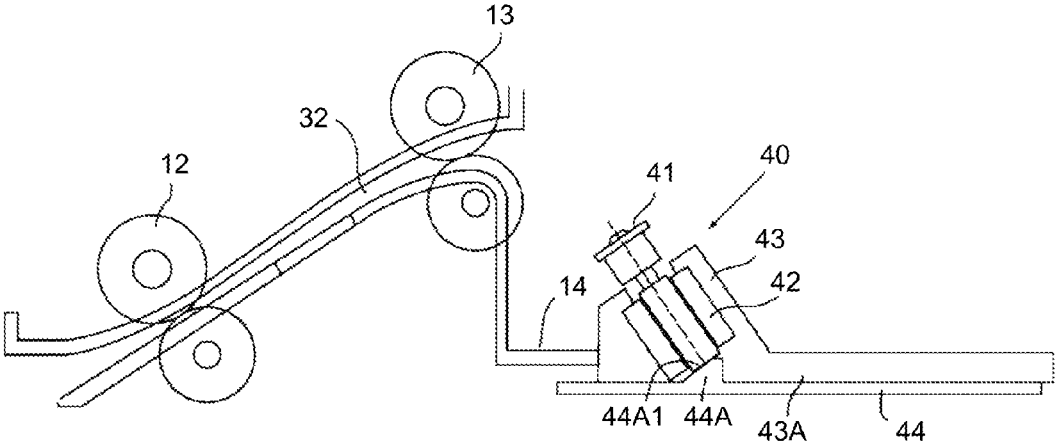
FIG. 16 is a diagram that illustrates a structure for raising a printing unit, which is intended for the configuration illustrated in FIG. 2.

FIG. 16 illustrates, as an object, part of the configuration illustrated in FIG. 2, i.e., the configuration for sliding the holding member 43 in a direction in which a document is moved on the sheet discharge tray 14.

In FIG. 16, the slidable member 43A of the holding member 43 slides on a guide member 44 that is provided on the lower surface of the slidable member 43A.

A raising member 44A is provided in part of the guide member 44, i.e., at the position where the printing unit 41 is moved to and located at the position retracted from the second conveyance path 32, which is one of the discharge paths, the raising member 44A protruding in a direction to raise the printing unit 41.

In the cross-sectional shape when viewed from the side, the raising member 44A includes a tilted surface 44A1, the height thereof sequentially increases from the upstream side to the downstream side in a direction to move to the retracted position, and the height of the tilted surface 44A1 is set to be a height so as to raise the printing unit 41 from the side of the holding member 43.

With the above configuration, when the holding member 43 moves the printing unit 41 to the position retracted from the second conveyance path 32, the bottom section of the printing unit 41 is moved while it is in contact with the lower section of the tilted surface 44A1 of the raising member 44A up to the upper section thereof. Accordingly, the printing unit 41 is raised so as to protrude from the upper surface of the holding member 43.

Thus, when the printing unit 41 is in the position retracted from the second conveyance path 32, the printing unit 41 protrudes from the upper surface of the holding member 43; thus, the position of the printing unit 41 can be set in a position where it is easily held.

As a result, in the same manner as the above-described embodiment, it is possible to eliminate the need for an operation to open the automatic document feeder, open part of the image forming apparatus, or the like, and, in addition, it is possible to improve the performance of removing the printing unit 41, i.e., the replacement performance.

Figure 17:
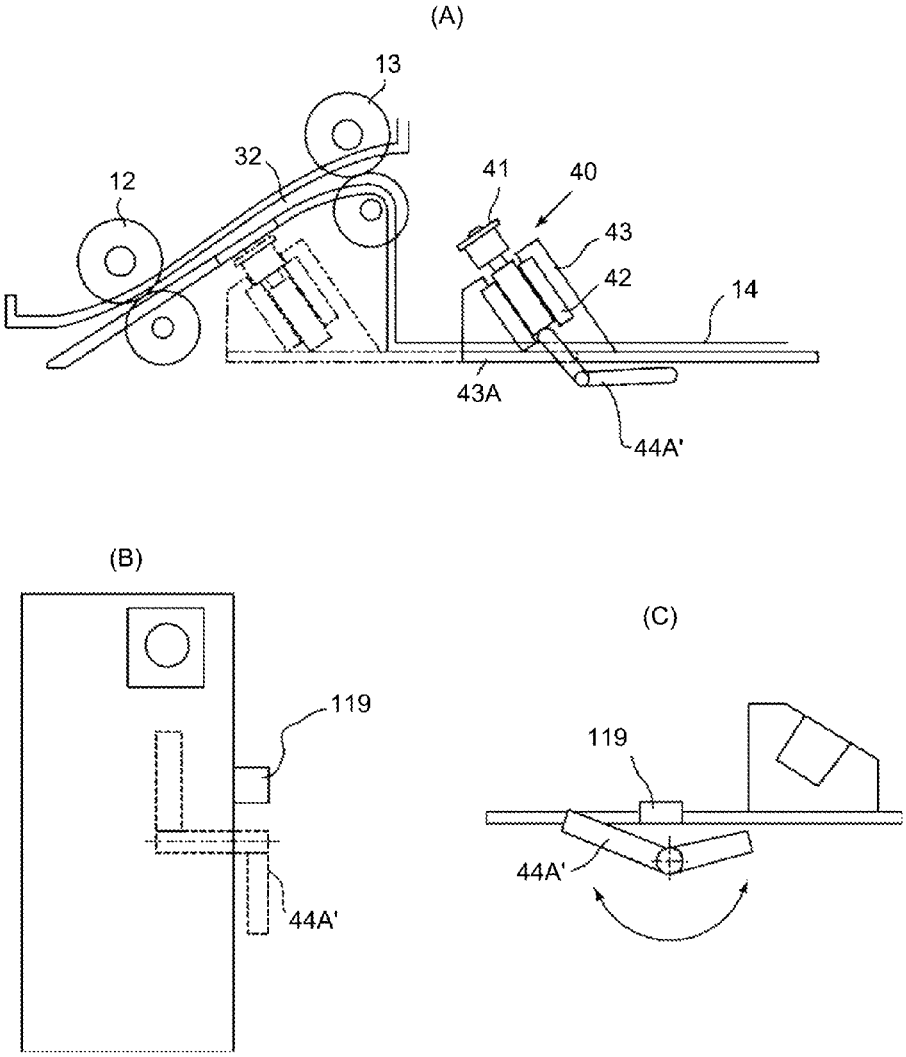
FIG. 17 illustrates a modification of the relevant part of the raising structure illustrated in FIG. 16.

FIG. 17 illustrates a modification of the relevant part of the configuration illustrated in FIG. 16.

In FIG. 17, a raising member 44A' is provided in the path through which the holding member 43 of the stamp device 40 moves, the raising member 44A' including a piece section that comes into contact with a protrusion section 119 (see (B) in FIG. 17) provided on the side of the holding member 43 and that jumps up so as to raise the printing unit 41.

The raising member 44A' is provided at a corresponding position where the stamp device 40 can be retracted from the second conveyance path 32 and be moved to above the sheet discharge tray 14.

The protrusion section 119 is provided at a position where the raising member 44A' can raise the printing unit 41 at a timing in which the stamp device 40 finishes moving to the position retracted from the second conveyance path 32.

As illustrated in FIG. 17, the raising member 44A' is a member that rotates around a support shaft that is provided in an immovable section of the automatic document feeder, one rotary end thereof faces the protrusion section 119 on the side of the holding member 43, and the other rotary end thereof faces the printing unit 41.

With this configuration, when the stamp device 40 is moved to the position retracted from the second conveyance path 32, the raising member 44A' interferes with the protrusion section 119 so as to rotate and raise the printing unit 41. Thus, after the printing unit 41 of the stamp device 40 moves to the position retracted from the second conveyance path 32, the printing unit 41 protrudes to the position where the head section thereof can be easily removed; thus, an operation to remove it with hands and fingers is performed in an easy way.

Figure 18:
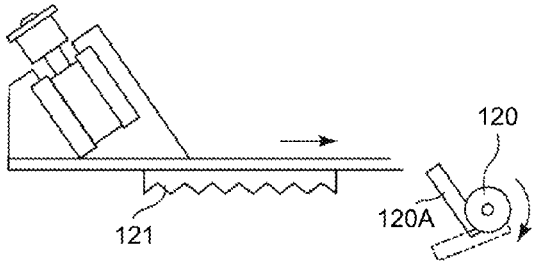
FIG. 18 is a diagram that illustrates another modification of the raising structure illustrated in FIG. 16.

FIG. 18 is a diagram that illustrates a modification of a raising member.

As the raising member illustrated in FIG. 18 is used a rod 120A that is integrated with a pinion 120 that rotates in accordance with the position where the stamp device 40 is retracted from the second conveyance path 32.

The pinion 120 can rotate when it is engaged with a rack 121 that is provided on the bottom surface of the holding member 43 of the stamp device 40.

The rack 121 is engaged with the pinion 120 in synchronization with the time when the stamp device 40 is moved to the position retracted from the second conveyance path 32 and, when the stamp device 40 moves to the above-described retracted position, the rod 120A enters the printing unit 41 so as to raise it.

With the above-described configurations, the raising members 44A and 44A' are operated in accordance with a movement of the stamp device 40; therefore, even if the power of the apparatus is not on, the printing unit 41 can be raised by moving the stamp device 40. Thus, it is not necessary to consume the electric power during replacement of the printing unit, and it is possible to reduce the costs for maintenance.

Furthermore, if the holding member 43 is moved to the position where the printing unit 41 is retracted from the second conveyance path 32, the holding member 43 is located within the sheet discharge tray 14.

Therefore, if the holding member 43 is not returned to cause the printing unit 41 to face the second conveyance path 32, there is a possibility that, when a document is discharged from the second conveyance path 32 into the sheet discharge tray 14, the document interferes with the holding member 43 that is located within the sheet discharge tray 14 and the document gets damaged.

Therefore, the present embodiment includes a configuration for, if the holding member 43 is not returned to the position where the printing unit 41 faces the second conveyance path, giving an alarm about the status. An explanation is given below of the configuration.

Figure 19:
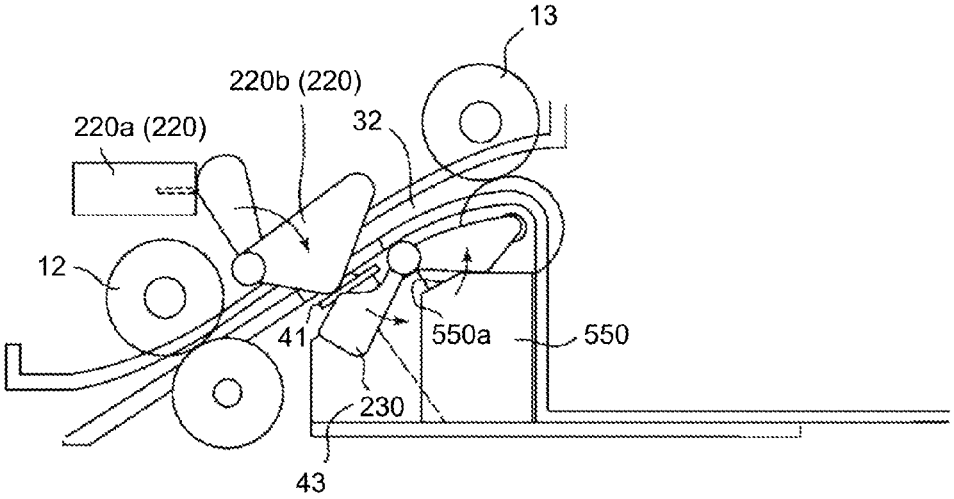
FIG. 19 is a schematic diagram that illustrates one mode of a configuration for detecting the presence or absence of a document in the automatic document feeder according to an embodiment of the present invention.

FIG. 19 is a diagram that illustrates a state where the position of the holding member 43 is set at the position where the printing unit 41 faces the second conveyance path 32.

In FIG. 19, a document detector 220 includes an optical sensor 220*a* and a filler member 220*b* that can move in and out of the second conveyance path 32 and rotate so as to block and pass the optical path of the optical sensor 220*a* in accordance with the state of an in-and-out movement.

The filler member 220*b* faces one surface of a document with the second conveyance path 32 interposed therebetween, and it faces a rotatable detector operating member 230 that is provided at the position facing the other surface of a document with the second conveyance path 32 interposed therebetween.

The filler member 220*b* is a member that changes the rotational position in accordance with the movement position of the stamp device 40 and that sets the blocking and open state of the optical path of the optical sensor 220*a*.

The filler member 220*b* has a rotational behavior in a clockwise direction in FIG. 19 due to an undepicted bias member, and the end of the filler member 220*b*, which is on the side opposite to the end thereof that faces the optical sensor 220*a*, can enter the second conveyance path 32.

As the filler member 220*b* is a member that has an area that enters the second conveyance path 32, it can be determined whether there is a document within the second conveyance path 32 as well as it is determined whether the stamp device 40 is not returned to the position of use.

Figure 20:
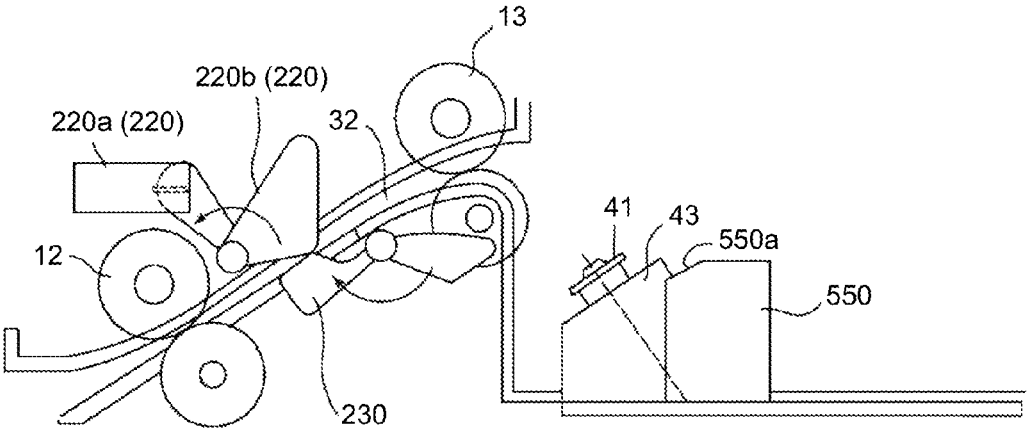
FIG. 20 is a schematic diagram that illustrates another aspect of the configuration illustrated in FIG. 19 for detecting the presence or absence of a document.

Specifically, when the area that enters the second conveyance path 32 is pushed by the document that is located within the second conveyance path 32, the optical path of the optical sensor 220*a* is blocked and it can be determined that there is a document by using the optical sensor 220*a*, as illustrated in FIG. 20.

Furthermore, the detector operating member 230 is a member that usually has a rotational behavior in a clockwise direction in FIG. 19 due to an undepicted bias unit and is a member that can set an in-and-out state thereof relative to the second conveyance path 32 in accordance with the shift position of a guide member 550 that can move in conjunction with the stamp device 40. Moreover, instead of using a bias unit, the length of each arm that extends from the support point as a border is changed to obtain a different strength of the rotational moment, whereby a rotational behavior in a clockwise direction can be obtained.

Specifically, the holding member 43 of the stamp device 40 is integrally provided with the guide member 550, and a tilted surface 550*a* is formed on part of the surface of the guide member 550 that faces the detector operating member 230, the tilted surface 550*a* enabling the detector operating member 230 to ride thereon.

When the stamp device 40 and the guide member 550 are moved and shifted from above the sheet discharge tray 14 to the position where the printing unit 41 faces the second conveyance path 32, part of the detector operating member 230 can ride on the tilted surface 550*a* of the guide member 550. Thus, the detector operating member 230 is rotated in a counterclockwise direction against the rotational behavior and is moved away from the filler member 220*b*.

As illustrated in FIG. 19, when the detector operating member 230 is moved away, the filler member 220*b* rotates in a clockwise direction due to its own rotational behavior and enters the second conveyance path 32.

As illustrated in FIG. 19, when the filler member 220*b* is not lifted up by the detector operating member 230, the filler member 220*b* rotates in a clockwise direction so as to open the optical path of the optical sensor 220*a*.

Furthermore, if the stamp device 40 and the guide member 550 are located above the sheet discharge tray 14 and are not returned to the position of use of the printing unit 41, the detector operating member 230 rotates in a clockwise direction and lifts up the filler member 220*b*, as illustrated in FIG. 20.

Thus, as the filler member 220*b* rotates in a counterclockwise direction and blocks the optical path of the optical sensor 220*a*, it gives an alarm to notify that the stamp device 40 and the guide member 550 remains on the sheet discharge tray 14, in the same manner as the case where there is a document within the second conveyance path 32.

With the above-described configuration, it can be determined whether the stamp device 40 remains on the sheet discharge tray 14 by using the document detector 220 that includes the optical sensor 220*a* and the filler member 220*b* that correspond to a document conveyance state detection unit that can be used in the existing configuration.

Thus, without adding a special configuration, it is possible to prevent damage to a document when the document is discharged in a state where the stamp device 40 remains on the sheet discharge tray 14, in other words, in a state where the stamp device 40 is not returned to the position facing the second conveyance path 32.

According to an aspect of the present invention, the printing unit is moved along a discharge path of a document between the position facing a document and the position retracted from a discharge path; therefore, it is possible to determine that, when the printing unit is moved to the retracted position, it is located away from the printing position inside the apparatus.

Therefore, the location of the printing unit can be determined by using a simple configuration, i.e., by simply moving it to each of the above-described positions; thus, it is possible to eliminate the need for an operation to open part of the apparatus, or the like, while performing an operation to replace the printing unit.

Although the invention has been described with respect to specific embodiments for a complete and clear disclosure, the appended claims are not to be thus limited but are to be construed as embodying all modifications and alternative constructions that may occur to one skilled in the art that fairly fall within the basic teaching herein set forth.

What is claimed is:

1. An automatic document feeder comprising:

a sheet feeding tray on which a document is stacked;

a slit glass on which the document is scanned while moving through a discharge path in which the document is conveyed after the document is scanned;

a document discharge device to which the document is discharged through the discharge path;

a stamp device that makes a mark on a scanned surface of the document being in the discharge path, wherein the stamp device includes a printing component facing the scanned surface of the document, and the printing component is movable between a first position at which the printing component faces the document being in the discharge path and a second position at which the printing component is retracted from the discharge path; and a sheet-feeding tray position regulating member that regulates a position of the sheet feeding tray not to return the sheet feeding tray to a set position, wherein the sheet-feeding tray position regulating member is movable in conjunction with a movement of the printing component to the second position.

2. The automatic document feeder according to claim 1, wherein the stamp device includes a drive member configured to move the printing component close to and away from the scanned surface of the document, and a holding member that supports the printing component, the holding member is provided such that the printing component is slidable along the discharge path between the first position and the second position, and the second position is a position where the printing component is checkable from outside.

3. The automatic document feeder according to claim 1, further comprising:

a first magnetic member provided near the first position; and a second magnetic member provided in the stamp device, the first magnetic member and the second magnetic member being magnetically attracted to each other.

4. The automatic document feeder according to claim 1, further comprising a raising member that raises the printing component from a holding member at the second position.

5. An image forming apparatus comprising the automatic document feeder according to claim 1.

6. The automatic document feeder according to claim 1, further comprising an elastic member that is connected to the stamp device so that the printing component is movable between the first position and the second position, wherein an elastic force of the elastic member is increased as the printing component moves toward the second position.

7. The automatic document feeder according to claim 6, further comprising:

a printing component position regulating member that regulates a movement of the printing component at the second position; and a printing component position regulation removing member that removes the regulation of the printing component position regulating member when the sheet feeding tray returns to a set position so that the printing component moves to the first position by an elastic force of the elastic member.

8. The automatic document feeder according to claim 1, comprising:

a document detector that detects the document, the document detector being provided in a position facing one surface of the document, the document detector being movable in and out of the discharge path;

a detector operating member that is provided in a position facing the other surface of the document across the discharge path, the detector operating member being movable back and forth relative to the document detector, the document detector and the detector operating member being provided across the discharge path from each other; and a guide member that sets an in-and-out state of the detector operating member in conjunction with a movement of a holding member, wherein the guide member has a tilted surface that faces the detector operating member, and the tilted surface is to set the document detector in a same state as a state in a case where there is a document in the discharge path when the printing component is at the second position.

9. An automatic document feeder comprising:

a sheet feeding tray on which a document is stacked;

a slit glass on which the document is scanned while moving through a discharge path in which the document is conveyed after the document is scanned;

a document discharge device to which the document is discharged through the discharge path;

a stamp device that makes a mark on a scanned surface of the document being in the discharge path, wherein the stamp device includes a printing component facing the scanned surface of the document, and the printing component is movable between a first position at which the printing component faces the document being in the discharge path and a second position at which the printing component is retracted from the discharge path;

an elastic member that is connected to the stamp device so that the printing component is movable between the first position and the second position, wherein an elastic force of the elastic member is increased as the printing component moves toward the second position;

a printing component position regulating member that regulates a movement of the printing component at the second position; and a printing component position regulation removing member that removes the regulation of the printing component position regulating member when the sheet feeding tray returns to a set position so that the printing component moves to the first position by an elastic force of the elastic member.

10. The automatic document feeder according to claim 9, wherein the stamp device includes a drive member configured to move the printing component close to and away from the scanned surface of the document, and a holding member that supports the printing component, the holding member is provided such that the printing component is slidable along the discharge path between the first position and the second position, and the second position is a position where the printing component is checkable from outside.

11. The automatic document feeder according to claim 9, further comprising:

a first magnetic member provided near the first position; and a second magnetic member provided in the stamp device, the first magnetic member and the second magnetic member being magnetically attracted to each other.

12. The automatic document feeder according to claim 9, further comprising a raising member that raises the printing component from a holding member at the second position.

13. An image forming apparatus comprising the automatic document feeder according to claim 9.

14. The automatic document feeder according to claim 9, comprising:

a document detector that detects the document, the document detector being provided in a position facing one surface of the document, the document detector being movable in and out of the discharge path;

a detector operating member that is provided in a position facing the other surface of the document across the discharge path, the detector operating member being movable back and forth relative to the document detector, the document detector and the detector operating member being provided across the discharge path from each other; and a guide member that sets an in-and-out state of the detector operating member in conjunction with a movement of a holding member, wherein the guide member has a tilted surface that faces the detector operating member, and the tilted surface is to set the document detector in a same state as a state in a case where there is a document in the discharge path when the printing component is at the second position.

15. An automatic document feeder comprising:

a sheet feeding tray on which a document is stacked;

a slit glass on which the document is scanned while moving through a discharge path in which the document is conveyed after the document is scanned;

a document discharge device to which the document is discharged through the discharge path;

a stamp device that makes a mark on a scanned surface of the document being in the discharge path, wherein the stamp device includes a printing component facing the scanned surface of the document, and the printing component is movable between a first position at which the printing component faces the document being in the discharge path and a second position at which the printing component is retracted from the discharge path;

a document detector that detects the document, the document detector being provided in a position facing one surface of the document, the document detector being movable in and out of the discharge path;

a detector operating member that is provided in a position facing the other surface of the document across the discharge path, the detector operating member being movable back and forth relative to the document detector, the document detector and the detector operating member being provided across the discharge path from each other; and a guide member that sets an in-and-out state of the detector operating member in conjunction with a movement of a holding member, wherein the guide member has a tilted surface that faces the detector operating member, and the tilted surface is to set the document detector in a same state as a state in a case where there is a document in the discharge path when the printing component is at the second position.

16. The automatic document feeder according to claim 15, wherein the stamp device includes a drive member configured to move the printing component close to and away from the scanned surface of the document, and a holding member that supports the printing component, the holding member is provided such that the printing component is slidable along the discharge path between the first position and the second position, and the second position is a position where the printing component is checkable from outside.

17. The automatic document feeder according to claim 15, further comprising:

a first magnetic member provided near the first position; and a second magnetic member provided in the stamp device, the first magnetic member and the second magnetic member being magnetically attracted to each other.

18. The automatic document feeder according to claim 15, further comprising a raising member that raises the printing component from a holding member at the second position.

19. An image forming apparatus comprising the automatic document feeder according to claim 15.

* * * * *